US007275031B2

(12) United States Patent
Hoerich et al.

(10) Patent No.: US 7,275,031 B2
(45) Date of Patent: Sep. 25, 2007

(54) APPARATUS AND METHOD FOR ENCODING AN AUDIO SIGNAL AND APPARATUS AND METHOD FOR DECODING AN ENCODED AUDIO SIGNAL

(75) Inventors: Holger Hoerich, Nuremberg (DE); Michael Schug, Erlangen (DE); Matthias Neusinger, Rohr (DE)

(73) Assignee: Coding Technologies AB, Stockholm (SE)

( * ) Notice: Subject to any disclaimer, the term of this patent is extended or adjusted under 35 U.S.C. 154(b) by 125 days.

(21) Appl. No.: 11/317,521

(22) Filed: Dec. 22, 2005

(65) Prior Publication Data

US 2006/0167683 A1 Jul. 27, 2006

Related U.S. Application Data

(63) Continuation of application No. PCT/EP2004/006850, filed on Jun. 24, 2004.

(30) Foreign Application Priority Data

Jun. 25, 2003 (DE) ..... 103 28 777

(51) Int. Cl.
*G10L 19/00* (2006.01)

(52) U.S. Cl. ..... 704/230; 704/229; 704/500; 704/200.1

(58) Field of Classification Search ..... 704/230, 704/229, 200.1, 500–504, 211, 212
See application file for complete search history.

(56) References Cited

U.S. PATENT DOCUMENTS 5,301,255 A * 4/1994 Nagai et al. ..... 704/230
5,732,391 A * 3/1998 Fiocca ..... 704/229
6,092,041 A * 7/2000 Pan et al. ..... 704/229

(Continued)

FOREIGN PATENT DOCUMENTS

DE 101 02 159 A1 1/2001

(Continued)

OTHER PUBLICATIONS

Purnhagen, et al. Der MPEG-Audio-Standart-Ein Ueberblick. Rundfunktechnische Mitteilungen.

(Continued)

*Primary Examiner*—Vijay Chawan
(74) *Attorney, Agent, or Firm*—Michael A. Glenn; Glenn Patent Group

(57) ABSTRACT

When encoding an audio signal, the audio signal is first encoded with the first encoder to obtain a first encoder output signal. This first encoder output signal is written into a bit stream. It is further decoded by a decoder to provide a decoded audio signal. The decoded audio signal is compared with the original audio signal to obtain a residual signal. The residual signal is then encoded via a second encoder to provide a second encoder output signal which is also written into a bit stream. The first encoder has a first time or frequency resolution. The second encoder has a second time or frequency resolution. The first resolution differs from the second resolution, so that in a respective decoder, an audio signal with both a high time resolution as well as a high frequency resolution can be retrieved.

11 Claims, 4 Drawing Sheets

U.S. PATENT DOCUMENTS

| | | | | |
|---|---|---|---|---|
| 6,094,636 | A * | 7/2000 | Kim | 704/500 |
| 6,108,625 | A * | 8/2000 | Kim | 704/229 |
| 6,115,688 | A | 9/2000 | Brandenburg et al. | |
| 6,169,973 | B1 * | 1/2001 | Tsutsui et al. | 704/500 |
| 6,263,312 | B1 * | 7/2001 | Kolesnik et al. | 704/500 |
| 6,377,916 | B1 * | 4/2002 | Hardwick | 704/208 |
| 6,446,037 | B1 * | 9/2002 | Fielder et al. | 704/229 |
| 6,658,383 | B2 * | 12/2003 | Koishida et al. | 704/229 |
| 6,980,951 | B2 * | 12/2005 | Chen | 704/222 |
| 7,050,972 | B2 * | 5/2006 | Henn et al. | 704/228 |
| 7,212,973 | B2 * | 5/2007 | Toyama et al. | 704/500 |
| 2004/0162911 | A1 | 8/2004 | Sperschneider et al. | |

FOREIGN PATENT DOCUMENTS

| | | |
|---|---|---|
| EP | 0 846 375 B2 | 8/1996 |
| WO | WO98/57436 | 6/1998 |

OTHER PUBLICATIONS

Brandenburg, et al. Comparison of Filterbanks for High Quality Audio Coding.

Grill, et al. A Two- or Three-Stage Bit Rate Scalable Audio Coding System. AES 99th Convention. Oct. 6-9, 1995. New York.

* cited by examiner

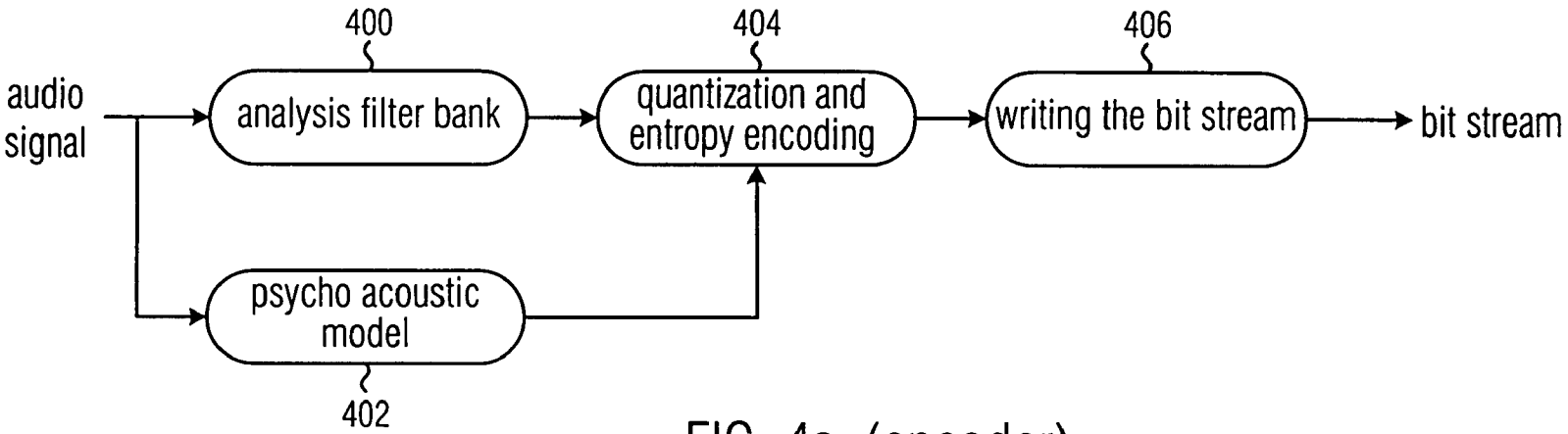
FIG. 4a (encoder)
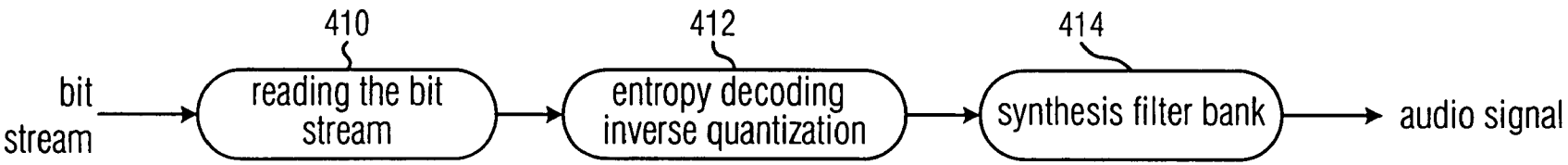
FIG. 4b (decoder)

APPARATUS AND METHOD FOR ENCODING AN AUDIO SIGNAL AND APPARATUS AND METHOD FOR DECODING AN ENCODED AUDIO SIGNAL

CROSS-REFERENCE TO RELATED APPLICATION

This application is a continuation of copending International Application No. PCT/EP04/006850, filed Jun. 24, 2004.

BACKGROUND OF THE INVENTION

1. Field of the Invention

The present invention relates to encoding techniques and particularly to audio encoding techniques.

2. Description of the Related Art

Audio encoders, and particularly such encoders known under the keyword "mp3", "AAC" or "mp3PRO" have recently gained wide acceptance. They allow the compression of audio signals, which require a significant amount of data, when they are present, for example, in PCM format on an audio CD, to "tolerable" data rates, which are suitable for the transmission of the audio signals across channels with limited bandwidth. Thus, for transmitting data in the PCM format, data rates of up to 1.4 Mbit/s are required. "mp3"-encoded audio data achieve already a stereo sound with high quality at data rates of 128 kbit/s.

Further, the spectral band replication (SBR) is a known method, which increases the efficiency of existing hearing adapted perceptual audio encoders significantly. The SBR technique is described in WO 98/57436 and implemented in the "mp3PRO" format. Here, a good stereo quality is already achieved with data rates of 64 kbit/s.

The European Patent EP 0 846 375 B1 discloses a method and an apparatus for scalable encoding of audio signals. An audio signal is encoded via a first encoder to obtain the bit stream for the first encoder. This signal is then decoded again, with a decoder adapted to the first encoder. The decoder output signal is supplied together with the delayed original audio signal to a differential stage to generate a differential signal. This differential signal is compared bandwise to the original audio signal in order to determine for spectral bands whether the energy of the differential signal is greater than the energy of the audio signal. If this is the case, the original audio signal will be supplied to a second encoder, while, when the energy of the differential signal is smaller than the energy of the original audio signal, the differential signal will be supplied to the second encoder. The second encoder is a transform encoder, which operates, based on a psychoacoustic model. Like the bit stream of the first encoder, the bit stream on the output side of the second encoder is also fed into a bit stream multiplexer, which provides a so-called scaled bit stream on the output side. In this connection, scalability means that a decoder is able, depending on the design, to extract either only the bit stream of the first encoder from the bit stream on the decoder side or to extract both the bit stream of the first encoder and the bit stream of the second encoder to obtain, in the first case, a less qualitative reproduction and in the second case a high quality reproduction of the original audio signal.

A typically transform-based encoder is illustrated in FIG. 4*a*. The audio signal is supplied to an analysis filter bank 400, which forms at its input a block with a certain number of samples of the audio signal from the stream of sample values via blocking and windowing, respectively, and converts it into a spectral representation. The spectral coefficients and subband signals, respectively, generated at the output of the analysis filter bank are quantized. The quantizer step width will depend on different factors. A significant factor is a psychoacoustic masking threshold, which is calculated by a psychoacoustic model 402 from the original audio signal. The quantizer in a block "quantizing and encoding 404" will always try to quantize as coarsely as possible to obtain a good compression. On the other hand, however, it will also try to quantize as finely as possible such that the quantizing noise introduced by the quantizing lies below the psychoacoustic masking threshold provided by block 402, as it is known in the art. The spectral values quantized in that way will then be subjected to an entropy encoding, wherein typically a Huffman encoding is used as entropy encoding, which typically operates with predefined Huffman code books and Huffman code tables, respectively. Then, entropy-encoded quantized spectral values are applied to the output of block 404, which are written into a bit stream 408 together with the side information required for the decoding via block 406, wherein this bit stream can be stored or, depending on the field of application, transmitted across a transmission channel to a decoder, which is illustrated in FIG. 4*b*. First, the decoder comprises a block 410 for reading the bit stream, to extract, on the one hand, the side information and, on the other hand, the entropy-encoded quantized spectral values from the bit stream. Then, the entropy-encoded quantized spectral values are first supplied to an entropy decoding and then to an inverse quantizing, to obtain inverse-quantized spectral values (block 412), which are then supplied via a synthesis filter bank 414 adapted to the analysis filter bank 400, to obtain a time-discrete decoded audio signal on the output side. This time-discrete audio signal at the output of the synthesis filter bank can then be supplied to a loudspeaker after appropriate interpolation and digital/analog conversion and, if necessary, amplification and thereby be made audible.

Block-based encoder/decoders, as they are used in the known scenario shown in FIGS. 4*a* and 4*b*, are based on the fact that typically a block of samples, such as 1024 and 2048 with an MDCT known in the art with Overlap and Add, respectively, time-discrete samples of audio signal are converted into the spectral range. Even with less frequency-resolving filter banks, such as the SBR filter bank with 64 channels, a block of samples with a certain number of samples is also always used and converted into a spectral representation, namely here the individual subband signals. Then, as has been discussed, the spectral representation will be quantized accordingly, typically with the help of a psychoacoustic model, which calculates the psychoacoustic masking threshold in the way known in the art.

Such transforms have inherently a certain time/frequency resolution. This means, that when a large number of samples are inserted into a block, a transform applied to the block does inherently have a high frequency resolution. On the other hand, the time resolution is reduced accordingly. If the shorter portions of the audio signal were converted into the spectral range for increasing the time resolution, this would lead to the fact that the frequency solution suffers correspondingly.

Therefore, it is a problem that audio signals can only be considered stationary for very short time periods. There are certainly short-term strong energy increases, which are called transients, during which the audio signal is not stationary.

In order to address this problem of time/frequency resolution, block switching, which is controlled by a transient detector, is used for example in the AAC encoder (AAC=advanced audio coding). Here, the audio signal to be encoded is examined prior to windowing and blocking, respectively, in order to determine whether the audio signal has such a transient or not. If a transient is determined, short blocks are used for encoding. If, however, a signal section without transient is detected, a long block length is used. Thus, in such common transform encoding methods, block switching is used for adapting the transform length to the signal. Particularly when low bit rates are to be achieved, preferably, very long transform lengths are used, since the ratio of page information to useful information is typically relatively independent of the block length. This means that the amount of page information is mostly the same, independent of the fact whether the block represents a large number of time samples of the audio signal or whether a block is short, i.e. represents a small number of samples. Thus, for reasons of encoding efficiency, one aims at using always block lengths as great as possible, and great transform lengths in a transform encoder, respectively.

On the other hand, for transient detection and switching to short windows at the appearance of non-stationary ranges of the audio signal, a processing effort has to accepted, which, however, still leads to the fact that the signal in its encoded form exists either only with good frequency resolution or only with good time resolution.

SUMMARY OF THE INVENTION

It is an object of the present invention to provide an improved concept for encoding and decoding, respectively, to obtain a higher-quality and still efficient audio encoding/decoding.

In accordance with a first aspect, the present invention provides an apparatus for encoding an audio signal, having: a first transform encoder for generating a first encoder output signal from the audio signal, wherein the first transform encoder is adapted to convert a block with a first number of time samples of the audio signal into a spectral representation to obtain the first encoder output signal; a decoder adapted to the first encoder for decoding the first encoder output signal to provide a decoded audio signal; a comparator for comparing the audio signal with the decoded audio signal, wherein the comparator is adapted to provide a residual signal, wherein the residual signal comprises a difference between the audio signal and the decoded audio signal; a second transform encoder for encoding the residual signal to provide a second encoder output signal, wherein the second transform encoder is adapted to convert a block with a second number of time samples of the audio signal into a spectral representation to obtain the second encoder output signal, wherein the first transform encoder and the second transform encoder are adapted so that the first number of time samples of the audio signal is greater than the second number of time samples of the audio signal and that the first encoder has a low time resolution and a high frequency resolution, and that the second encoder has a high time resolution and a low frequency resolution; and a multiplexer for combining the first encoder output signal and the second encoder output signal to obtain an encoded audio signal.

In accordance with a second aspect, the present invention provides a method for encoding an audio signal, having the steps of: generating a first output signal with a first time or frequency resolution from the audio signal, wherein the step of generating includes the step of converting a block with a first number of time samples of the audio signal into a spectral representation to obtain the first output signal; decoding the first encoder output signal to provide a decoded audio signal; comparing the audio signal with the decoded audio signal to provide a residual signal, wherein the residual signal comprises a difference between the audio signal and the decoded audio signals; encoding the residual signal with a second time or frequency resolution to provide a second output signal wherein the step of encoding includes the step of converting a block with a second number of time samples of the audio signal into a spectral representation to obtain the second output signal; wherein the step of generating and the step of encoding are adapted so that the first number of time samples of the audio signal is greater than the second number of time samples of the audio signal and that the first output signal has a low time resolution and a high frequency resolution, and that the second output signal has a high time resolution and a low frequency resolution; and combining the first encoder output signal and the second encoder output signal to obtain an encoded audio signal.

In accordance with a third aspect, the present invention provides an apparatus for decoding an encoded audio signal to obtain an output signal, wherein the encoded audio signal has a first encoder output signal, which is encoded with a high time resolution and a low frequency resolution, and wherein the encoded audio signal further has a second encoder output signal, which represents a residual signal encoded with a high time resolution and a low frequency resolution, which represents a difference between an original audio signal and a decoded audio signal, wherein the decoded audio signal can be obtained by decoding the first encoder output signal, wherein the first encoder output signal has been generated using a first transform encoder wherein the first transform encoder is adapted to convert a block with a high number of time samples of the audio signal into a spectral representation to obtain the first encoder output signal, wherein the second encoder output signal has been generated using a second transform encoder, and wherein the second transform encoder is adapted to convert a block with a low number of time samples of the audio signal into a spectral representation to obtain the second encoder output signal, having: an extractor for extracting the first encoder output signal and the second encoder output signal from the encoded audio signal; a first transform decoder, adapted to the first transform encoder, for decoding the first encoder output signal to obtain the decoded audio signal, wherein the first decoder is adapted to operate with the low time resolution and the high frequency resolution, and wherein the first transform decoder is adapted to convert a block with a first number of spectral values into a time representation; a second transform decoder, adapted to the second transform encoder, for decoding the second encoder output signal to obtain a decoded residual signal, wherein the second decoder is adapted to operate with the high time resolution and the low frequency resolution, and wherein the second transform decoder is adapted to convert a block with a second number of spectral values into a time representation, the second number being smaller than the first number, and a combiner for combining the decoded audio signal and the decoded residual signal to obtain the output signal.

In accordance with a fourth aspect, the present invention provides a method of decoding an encoded audio signal to obtain an output signal, wherein the encoded audio signal has a first encoder output signal, which is encoded with a high time resolution and a low frequency resolution, and wherein the encoded audio signal further has a second encoder output signal, which represents a residual signal encoded with a high time resolution and a low frequency resolution, which represents a difference between an original audio signal and a decoded audio signal, wherein the decoded audio signal can be obtained by decoding the first encoder output signal, wherein the first encoder output signal has been generated using a first transform encoder wherein the first transform encoder is adapted to convert a block with a high number of time samples of the audio signal into a spectral representation to obtain the first encoder output signal, wherein the second encoder output signal has been generated using a second transform encoder, and wherein the second transform encoder is adapted to convert a block with a low number of time samples of the audio signal into a spectral representation to obtain the second encoder output signal, the method having the steps of: extracting the first encoder output signal and the second encoder output signal from the encoded audio signal; decoding, adapted to the first transform encoder, the first encoder output signal to obtain the decoded audio signal, wherein the step of decoding is adapted to operate with the low time resolution and the high frequency resolution, and wherein the step of decoding is adapted to convert a block with a first number of spectral values into a time representation; decoding, adapted to the second transform encoder, the second encoder output signal to obtain a decoded residual signal, wherein the step of decoding is adapted to operate with the high time resolution and the low frequency resolution, and wherein the step of decoding is adapted to convert a block with a second number of spectral values into a time representation, the second number being smaller than the first number, and combining the decoded audio signal and the decoded residual signal to obtain the output signal.

In accordance with a fifth aspect, the present invention provides a computer program with a program code for performing the above-mentioned methods when the program runs on a computer.

The present invention is based on the knowledge that good encoding quality of both good frequency resolution and good time resolution is achieved by the fact that, in the sense of the concept of scalability, a first encoder has a first time/frequency solution, and that a second encoder has a second time/frequency resolution, which differ from one another, so that the first encoder encodes the original audio signal with a certain resolution and that the second encoder operates then with a certain different resolution with regard to time and frequency, respectively, so that two data streams are obtained, which, when considered together, represent both a good time resolution and a good frequency resolution.

Above that, not the original audio signal is supplied to the second encoder, but the difference between the original audio signal and the encoded and re-decoded result of the first encoder/decoder. The resolution error, which the first encoder has made, appears then automatically in the residual signal, which is obtained, for example, by difference formation, wherein the residual signal will typically have errors, for example due to the bad time resolution of the first encoder/decoder path. By contrast, the residual signal will hardly have respective frequency errors since the first encoder/decoder path had a good frequency resolution. Thus, the residual signal can be encoded easily with an encoder with high time resolution (and thus respectively bad frequency resolution), to obtain a signal as second encoding output signal which has a good time resolution, but a bad frequency resolution, which however does not matter since the first encoder output signal has already a good frequency resolution and thus reproduces the frequency-wise considered structure of the audio signal very well.

In a preferred embodiment of the present invention, both the first encoder and the second encoder are transform encoders. Further, it is preferred to operate the first encoder with a high frequency resolution (and thus a bad time resolution), i.e. with a high transform length, while the second encoder is operated with a high time resolution (and thus a bad frequency resolution).

According to the invention, it has been found out that artifacts in the time domain, which means artifacts due to a bad time resolution, are in many cases rather accepted than artifacts in the frequency domain, i.e. artifacts due to a bad frequency resolution. Thus, it is preferred to operate the first encoder with a high frequency resolution, since then merely the first encoder output signal from a respective decoder is sufficient to obtain a reasonably good audio output, which lies within the concept of scalability.

According to the invention, the quality of the first encoder method is improved by the second encoder, by performing a difference formation between the output signal of the first encoder/decoder path and the original audio signal, and that then the resulting residual signal is encoded with the second encoder, which has a good time resolution. This encoding is particularly favorable for the residual signal, since it already comprises few tonal elements, since they have already been very well and efficiently captured by the first encoding method.

The significant deficiency of this residual signal, however, is the bad time resolution, which shows in the generation of noise prior or after a transient, i.e. a pre-echo or post-echo. Pre-echos are more disturbing than post-echos, since they are easily detectable for a subjective. So to speak, this noise is the quantizing noise of the transient and corresponds in its spectral content mainly to the one of the transient and is thus not tonal. Thus, by using the transform encoding method with shorter blocks, i.e. with a high time resolution, the time resolution is considerably improved in an efficient way.

Thus, according to the invention, an audio encoding method with high and highest quality is obtained, by detecting the portions of the audio signal, which are tonal or rather tonal, with a frequency-selective transform encoding method with long transform lengths, while a downstream encoding method with short transform length enables a high time resolution for the residual signal.

BRIEF DESCRIPTION OF THE DRAWINGS

These and other objects and features of the present invention will become clear from the following description taken in conjunction with the accompanying drawings, in which:

FIG. 4*a* is a known transform encoder; and

FIG. 4*b* is a known transform decoder.

DESCRIPTION OF THE PREFERRED EMBODIMENTS

Figure 1:
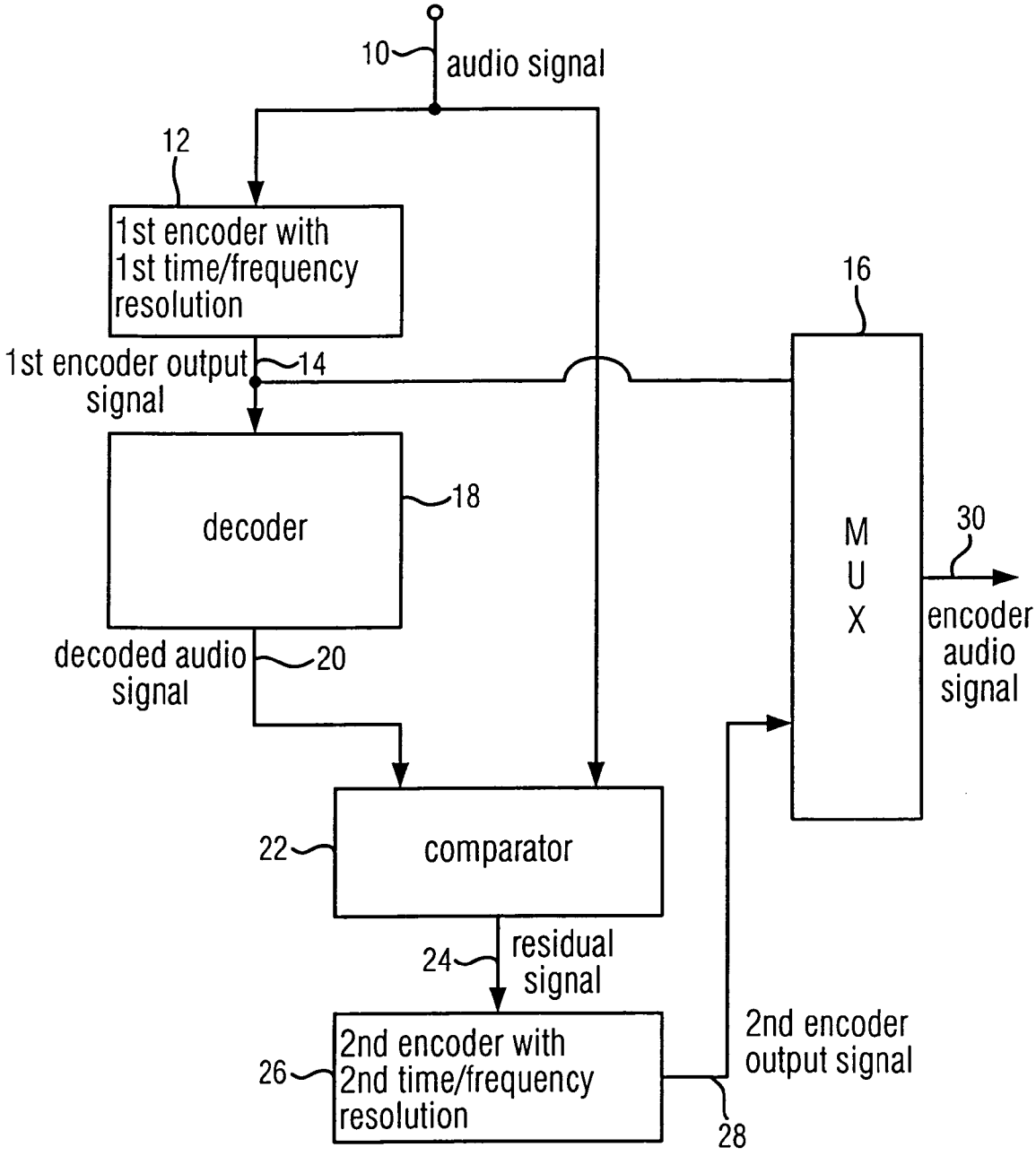
FIG. 1 is a block diagram of an inventive encoding concept.

FIG. 1 shows an apparatus for encoding an audio signal, which is provided via input 10. First, the audio signal is fed into a first encoder 12 with a first time/frequency resolution. The first encoder 12 is formed to generate a first encoder output signal at an output 14. The first encoder output signal at output 14 of the first encoder 12 will be supplied, on the one hand, to a multiplexer 16, and, on the other hand, to a decoder 18, which is adapted to the first encoder and decodes the first encoder output signal to provide a decoded audio signal at an output 20 of the decoder 18. The decoded output signal 20 as well as the original audio signal 10 is supplied to a comparator 22. The comparator 22 is formed to compare the audio signal at the input 10 to the decoded audio signal at the output 20, which means after the path from the first encoder 12 and decoder 18. The comparator 22 is particularly formed to provide a residual signal at one of its outputs 24, wherein the residual signal comprises a difference between the audio signal and the decoded audio signal. This residual signal 24 is supplied to a second encoder 26, which is formed to encode the residual signal at the output 24 of the comparator 22 to provide a second encoder output signal at an output 28, which is also supplied to the multiplexer 16. The multiplexer 16 is formed to combine the first encoder output signal and the second encoder output signal and to generate therefrom an encoded audio signal at an output 30, if necessary under consideration of corresponding side information and bit stream syntax conventions.

According to the invention, the first encoder has a first time or frequency resolution and the second encoder has a second time or frequency resolution. According to the present invention, the first resolution of the first encoder and the second resolution of the second encoder differ, so that the first encoder output signal is either well encoded time or frequency wise, and that the second encoder output signal is well encoded frequency or time wise, such that the encoded audio signal at the output of the multiplexer 16 has both a high time resolution and a high frequency resolution.

Below, a preferred embodiment of the present invention is illustrated with reference to FIG. 2. Here, an audio signal 10 is subjected to a delay by a delay member 32 prior to supplying it to the comparator 22, which is illustrated as difference member in FIG. 2, so that in the preferred embodiment shown in FIG. 2, a samplewise difference formation can be performed in real time by the difference member 22 between the decoded audio signal at the output of the decoder 18 and the (delayed) audio signal at the output of the delay member 32.

Figure 2:
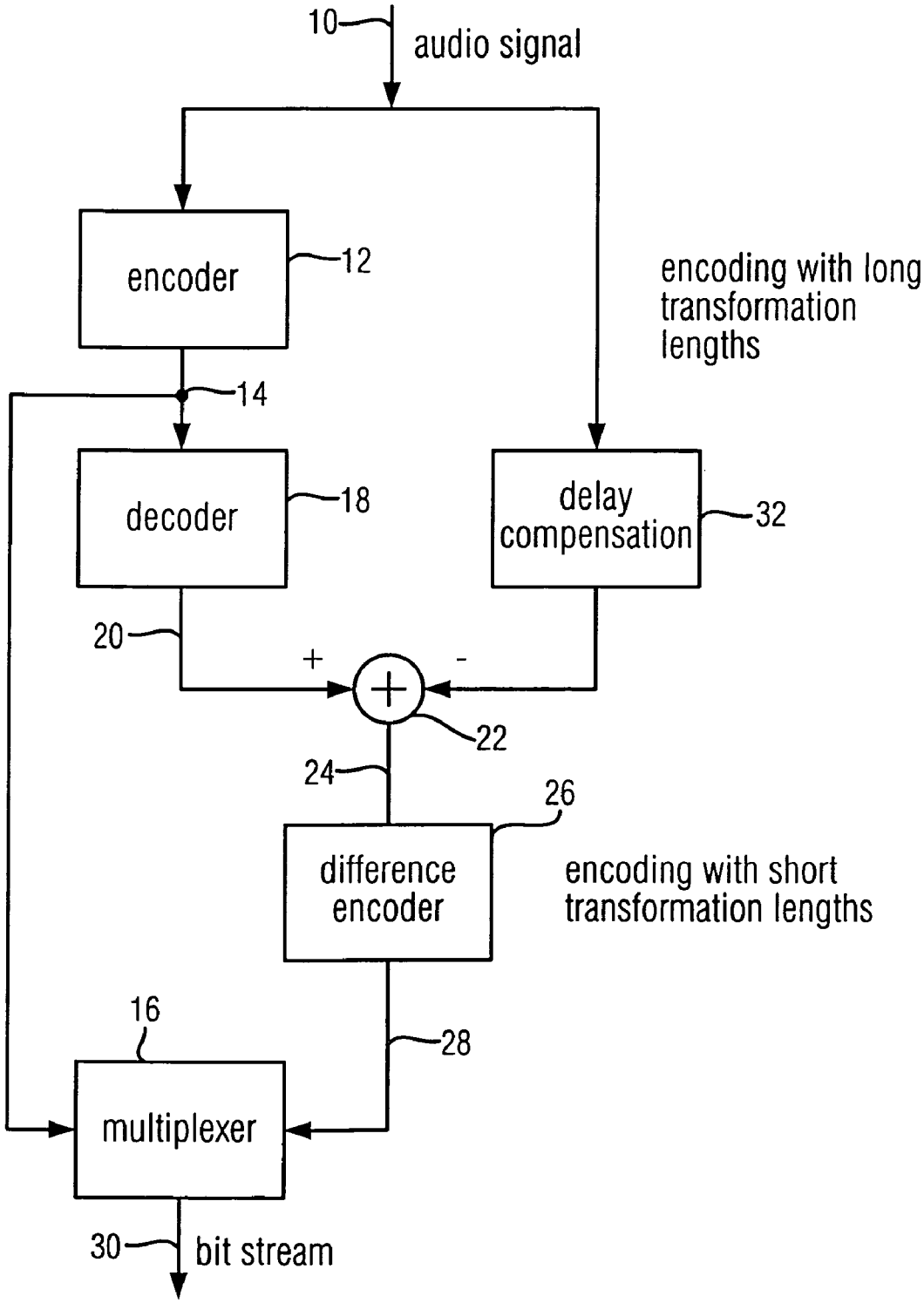
FIG. 2 is a block diagram of an inventive encoding concept according to a preferred embodiment of the present invention.

In the embodiment shown in FIG. 2, further, the first encoder, i.e. the encoder 12 in FIG. 2, and the second encoder 26, which is referred to as difference encoder in FIG. 2, are formed to perform a transform encoding.

Further, it is preferred that the first encoder 12 performs an encoding with long transform length, i.e. a high frequency resolution and thus a low time resolution, while the second encoder 26 performs an encoding with a short transform length, which means for the high time resolution and inherently therewith a low frequency resolution.

Although, in principle, the first encoder could also operate with short transform lengths and the difference encoder with long transform lengths, it is still preferred to run the first encoder with long transform lengths, since, as has already been explained, time artifacts are rather less problematic for a listener than frequency artifacts. Thus, an encoder that can only process the first encoder output signal at the output 14 but not the second encoder output signal at the output 28 can generate a more pleasant reproduction if the first encoder operates with long transform lengths, then when the first encoder would work with short transform lengths.

Any means for converting a block of time samples into a spectral representation can be used as transform algorithm within the first encoder and/or the second encoder of FIG. 2, such as a Fourier transform, a discrete Fourier transform, a fast Fourier transform, a discrete cosine transform, a modified discrete cosine transform, etc. Alternatively, a filter bank with a small number of channels can be used, such as a 64-channel filter bank, a 128-channel filter bank or a filter bank with more or less channels.

In another embodiment of the present invention, the first encoder 12 can be an SBR encoder, which is formed to provide a first encoder output signal, which comprises only information up to a cut off frequency, which is smaller than the cut off frequency of the audio signal at the audio input 10. Typical SBR encoders extract side information from the audio signal, which can be used for high frequency reconstruction in an SBR decoder, to reconstruct the high band, which means the band of the audio signal above the cut off frequency of the first encoder output signal, with a quality as high as possible. However, the decoder 18 in FIG. 2 is no such SBR decoder with high frequency reconstruction, but a common transform decoder, which is adapted to the first encoder 12, to simply decode the encoder output signal independent of the fact that the same band is limited, so that the output signal of the decoder 18 at the output 20 has also a lower cut off frequency than the original audio signal.

In that case, the residual signal up to the cut off frequency would comprise the encoder/decoder error of the path of encoder 12 and decoder, but would be the complete audio signal above the cut off frequency.

In that case, the residual signal could either also be encoded with a difference encoder 26, which uses short transform lengths, since it corresponds to the original audio signal above the cut off frequency of the first encoder output signal. Alternatively, however, only the spectral range of the residual signal up to the cut off frequency of the first encoder output signal could be encoded with the difference encoder 26, while the high frequent portion of the residual signal is encoded again with the first encoder 12 with the long transform lengths, to also obtain a high frequency resolution in the high-frequency part of the audio signal.

The output signal of the encoder 12 for the high-frequency band can then be compared again with the respective band of the original audio signal to encode the difference signal again with the difference encoder 26, so that in the end four data streams are supplied to the multiplexer 16, which, when they are all decoded together enable a transparent reproduction, i.e. a reproduction without artifacts.

According to the invention, it is not significant that the first encoder and the second encoder operate by using a psychoacoustic model. For data efficiency reasons, however, it is preferred that at least the first encoder 12 operates by using a psychoacoustic model. Depending on resources, the second encoder could then encode lossless, when the respective transmission channel resources are present, so that a fully transparent reproduction is achieved. Alternatively, the second encoder could also operate by using a psychoacoustic model, wherein it is preferred that in this case the psychoacoustic model is not again fully calculated for the second encoder, but that at least parts of the same and the whole psychoacoustic masking threshold, respectively, can be "reused" under consideration of the different transform lengths of the first encoder to the second encoder. This can, for example, take place by taking the psychoacoustic masking threshold calculated by the first encoder immediately for the second encoder, wherein, however, for example a "security surcharge" of, for example, 3 dB is used for taking into account the shorter transform lengths of the second encoder, such that the psychoacoustic masking threshold for the second encoder is, for example, by 3 dB or another predetermined amount smaller than the psychoacoustic masking threshold for the first encoder 12.

With regard to the transform lengths, it is preferred that the transform length of the first encoder is an integer plurality of the transform length of the second encoder. That way, the transform length of the first encoder can comprise for example twice as many, three times as many, four times as many or five times as many samples of the audio signal than the transform length of the second encoder 26. This integer relation between the transform length of the first and the second encoder is therefore preferred, since then a relatively good reuse of encoder data of the first encoder for the second encoder becomes possible. On the other hand, a non-integer connection between the transform length would also be unproblematic, since the first encoder 12 and the second encoder 26 can also run not synchronized to one another, as long as this is reported accordingly to a decoder, so that the same performs the summation with the correct samples, which means the inverse of the samplewise difference formation in the element 22 of FIG. 2.

Figure 3:
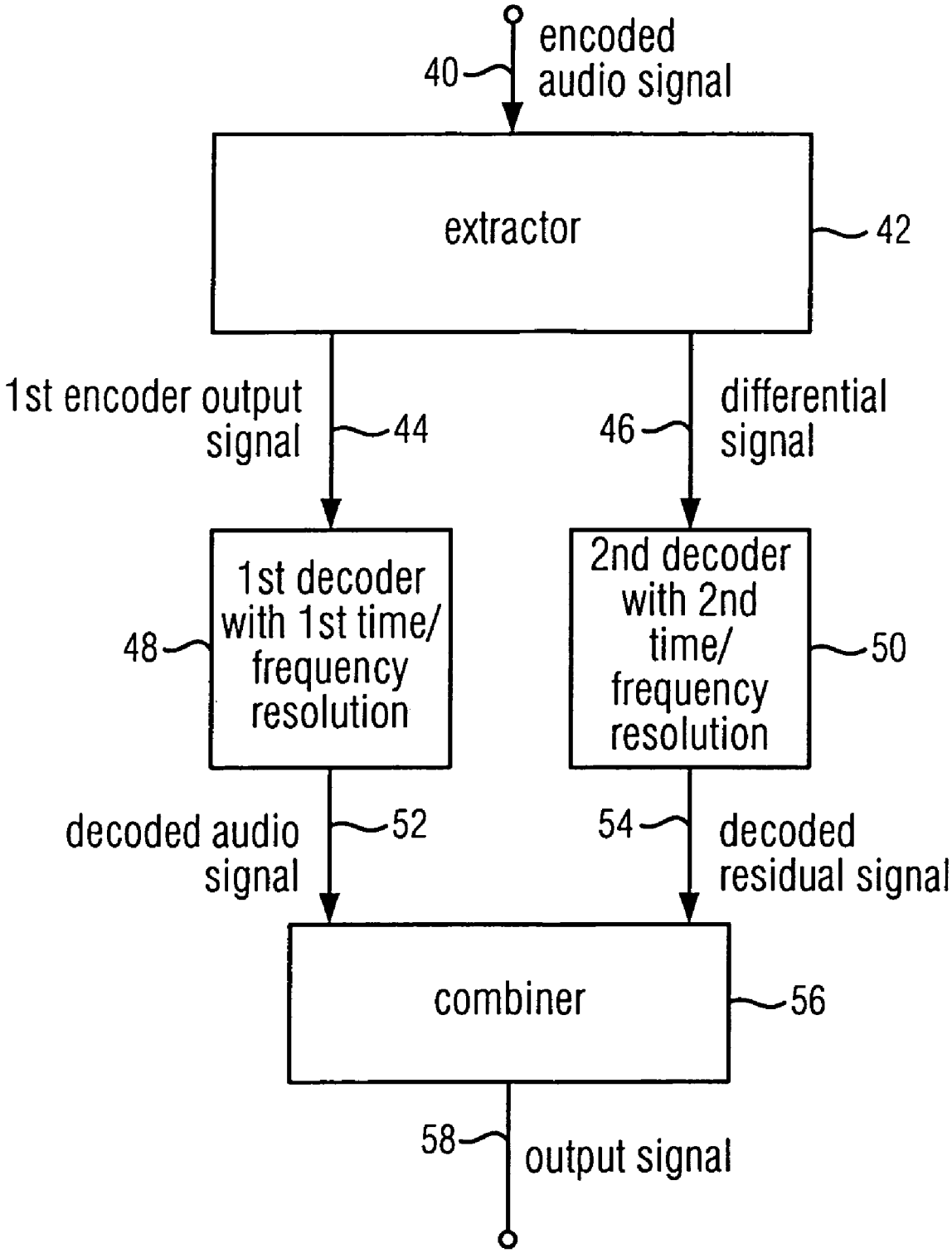
FIG. 3 is a block diagram of an inventive decoder concept.

FIG. 3 shows a decoder for decoding an encoded audio signal according to the present invention. The encoded audio signal, which is output at the output 30 of FIG. 1 and FIG. 2, respectively, is supplied to an input 40 of the decoder in FIG. 3 after transmission, storage, etc. The input 40 is first coupled to an extractor 42, which has the functionality of a bit stream demultiplexer, to extract first the first encoder output signal from the encoded audio signal and to provide it at an output 44, and which is further formed to provide the encoded residual signal and the difference signal, respectively, and the second encoded audio signal, respectively, at an output 46. The first encoder output signal is supplied to a first decoder, which is adapted to the first encoder 12 of the inventive apparatus for encoding shown in FIG. 1, and can, in principle, be identical to the decoder 18 of FIG. 1. This means that the first decoder 48 has again the same time/frequency resolution, which means operates, for example, with the same transform length than the encoder 12 of FIG. 1. The second encoder output signal at the output 46 of the extractor is supplied to a second decoder 50, which is adapted to the second encoder 26 of FIG. 1 and has thus the second time/frequency resolution, which means a time/frequency resolution, which is identical to the time/frequency resolution of the second encoder 26 in FIG. 1.

On the output side, the first encoder 48 provides the decoded audio signal, which can be identical to the signal at the output 20 of FIG. 2. Analogously, the second decoder 50 provides the decoded residual signal at its output. It should be noted that both decoders can be formed in principle as illustrated with reference to FIG. 4*b*, wherein the same can however differ with regard to their transform lengths and thus to the used synthesis filter banks.

Both the decoded audio signal at the output 52 in FIG. 3 and the decoded residual signal at the output 54 of FIG. 3 are supplied to a combiner 56, which performs a samplewise summation in a preferred embodiment of the present invention, which means generally an operation which is inverse to the comparison operation, which has been performed in the encoder in element 22 of FIG. 1. On the output side, the combiner 56 provides at an output 58 of the decoder apparatus of FIG. 3 an output signal, which stands out due to the present invention both through a good time resolution and a good frequency resolution, i.e. it comprises both few frequency artifacts and few time artifacts.

Depending on the circumstances, the inventive method for encoding, as illustrated with regard to FIG. 1, or the inventive method for decoding as illustrated with regard to FIG. 3, can be implemented in hardware or in software. The implementation can be performed on a digital storage medium, particularly a disc or a CD with electronically readable control signals, which can interact with a programmable computer system such that the respective method is executed. Thus, the invention consists generally also of a computer program product with a program code stored on a machine readable carrier for performing the inventive method when the computer program product runs on a computer. In other words, the invention can also be realized as a computer program with a program code for performing the method when the computer program runs on a computer.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. Apparatus for encoding an audio signal, comprising:

a first transform encoder for generating a first encoder output signal from the audio signal, wherein the first transform encoder is adapted to convert a block with a first number of time samples of the audio signal into a spectral representation to obtain the first encoder output signal;

a decoder adapted to the first encoder for decoding the first encoder output signal to provide a decoded audio signal;

a comparator for comparing the audio signal with the decoded audio signal, wherein the comparator is adapted to provide a residual signal, wherein the residual signal comprises a difference between the audio signal and the decoded audio signal;

a second transform encoder for encoding the residual signal to provide a second encoder output signal, wherein the second transform encoder is adapted to convert a block with a second number of time samples of the audio signal into a spectral representation to obtain the second encoder output signal, wherein the first transform encoder and the second transform encoder are adapted so that the first number of time samples of the audio signal is greater than the second number of time samples of the audio signal and that the first encoder has a low time resolution and a high frequency resolution, and that the second encoder has a high time resolution and a low frequency resolution; and a multiplexer for combining the first encoder output signal and the second encoder output signal to obtain an encoded audio signal.

2. Apparatus according to claim 1, wherein the first encoder and the second encoder have a filter bank or transform algorithm, which comprises a Fourier transform, a discrete Fourier transform, a fast Fourier transform, a discrete cosine transform or a modified cosine transform.

3. Apparatus according to claim 1, wherein the decoder is adapted to provide a time-discrete decoded audio signal with a sequence of samples, wherein the audio signal is a time-discrete audio signal with a sequence of samples, and wherein the comparator is adapted to perform a samplewise difference formation to obtain the residual signal.

4. Apparatus according to claim 1, further comprising:

a delay member for delaying the audio signal, wherein the delay member is adapted to have a delay, which depends on a delay, associated to the first encoder and the decoder.

5. Apparatus according to claim 1, wherein the multiplexer is adapted to generate the encoded audio signal such that the first encoder output signal can be decoded independent of the second encoder output signal.

6. Apparatus according to claim 1, wherein the first encoder is adapted to subject the audio signal to a band limitation, so that the first encoder output signal has an upper cut off frequency, which is smaller than an upper cut off frequency of the audio signal, wherein the comparator provides a residual signal which corresponds to the audio signal above the upper cut off frequency of the first encoder output signal, and wherein the second encoder is adapted to encode a portion of the residual signal above the upper cut off frequency of the first encoder with a time or frequency resolution, which is unequal to the second resolution or equal to the second resolution.

7. Method for encoding an audio signal, comprising:

generating a first output signal with a first time or frequency resolution from the audio signal, wherein the step of generating includes the step of converting a block with a first number of time samples of the audio signal into a spectral representation to obtain the first output signal;

decoding the first encoder output signal to provide a decoded audio signal;

comparing the audio signal with the decoded audio signal to provide a residual signal, wherein the residual signal comprises a difference between the audio signal and the decoded audio signals;

encoding the residual signal with a second time or frequency resolution to provide a second output signal wherein the step of encoding includes the step of converting a block with a second number of time samples of the audio signal into a spectral representation to obtain the second output signal;

wherein the step of generating and the step of encoding are adapted so that the first number of time samples of the audio signal is greater than the second number of time samples of the audio signal and that the first output signal has a low time resolution and a high frequency resolution, and that the second output signal has a high time resolution and a low frequency resolution; and combining the first encoder output signal and the second encoder output signal to obtain an encoded audio signal.

8. Apparatus for decoding an encoded audio signal to obtain an output signal, wherein the encoded audio signal has a first encoder output signal, which is encoded with a high time resolution and a low frequency resolution, and wherein the encoded audio signal further has a second encoder output signal, which represents a residual signal encoded with a high time resolution and a low frequency resolution, which represents a difference between an original audio signal and a decoded audio signal, wherein the decoded audio signal can be obtained by decoding the first encoder output signal, wherein the first encoder output signal has been generated using a first transform encoder wherein the first transform encoder is adapted to convert a block with a high number of time samples of the audio signal into a spectral representation to obtain the first encoder output signal, wherein the second encoder output signal has been generated using a second transform encoder, and wherein the second transform encoder is adapted to convert a block with a low number of time samples of the audio signal into a spectral representation to obtain the second encoder output signal, comprising:

an extractor for extracting the first encoder output signal and the second encoder output signal from the encoded audio signal;

a first transform decoder, adapted to the first transform encoder, for decoding the first encoder output signal to obtain the decoded audio signal, wherein the first decoder is adapted to operate with the low time resolution and the high frequency resolution, and wherein the first transform decoder is adapted to convert a block with a first number of spectral values into a time representation;

a second transform decoder, adapted to the second transform encoder, for decoding the second encoder output signal to obtain a decoded residual signal, wherein the second decoder is adapted to operate with the high time resolution and the low frequency resolution, and wherein the second transform decoder is adapted to convert a block with a second number of spectral values into a time representation, the second number being smaller than the first number, and a combiner for combining the decoded audio signal and the decoded residual signal to obtain the output signal.

9. Method of decoding an encoded audio signal to obtain an output signal, wherein the encoded audio signal has a first encoder output signal, which is encoded with a high time resolution and a low frequency resolution, and wherein the encoded audio signal further has a second encoder output signal, which represents a residual signal encoded with a high time resolution and a low frequency resolution, which represents a difference between an original audio signal and a decoded audio signal, wherein the decoded audio signal can be obtained by decoding the first encoder output signal, wherein the first encoder output signal has been generated using a first transform encoder wherein the first transform encoder is adapted to convert a block with a high number of time samples of the audio signal into a spectral representation to obtain the first encoder output signal, wherein the second encoder output signal has been generated using a second transform encoder, and wherein the second transform encoder is adapted to convert a block with a low number of time samples of the audio signal into a spectral representation to obtain the second encoder output signal, the method comprising:

extracting the first encoder output signal and the second encoder output signal from the encoded audio signal;

decoding, adapted to the first transform encoder, the first encoder output signal to obtain the decoded audio signal, wherein the step of decoding is adapted to operate with the low time resolution and the high frequency resolution, and wherein the step of decoding is adapted to convert a block with a first number of spectral values into a time representation;

decoding, adapted to the second transform encoder, the second encoder output signal to obtain a decoded residual signal, wherein the step of decoding is adapted to operate with the high time resolution and the low frequency resolution, and wherein the step of decoding is adapted to convert a block with a second number of spectral values into a time representation, the second number being smaller than the first number, and combining the decoded audio signal and the decoded residual signal to obtain the output signal.

10. Computer program with a program code for performing the method for encoding an audio signal, comprising:

generating a first output signal with a first time or frequency resolution from the audio signal, wherein the step of generating includes the step of converting a block with a first number of time samples of the audio signal into a spectral representation to obtain the first output signal;

decoding the first encoder output signal to provide a decoded audio signal;

comparing the audio signal with the decoded audio signal to provide a residual signal, wherein the residual signal comprises a difference between the audio signal and the decoded audio signals;

encoding the residual signal with a second time or frequency resolution to provide a second output signal wherein the step of encoding includes the step of converting a block with a second number of time samples of the audio signal into a spectral representation to obtain the second output signal;

wherein the step of generating and the step of encoding are adapted so that the first number of time samples of the audio signal is greater than the second number of time samples of the audio signal and that the first output signal has a low time resolution and a high frequency resolution, and that the second output signal has a high time resolution and a low frequency resolution; and combining the first encoder output signal and the second encoder output signal to obtain an encoded audio signal, when the program runs on a computer.

11. Computer program with a program code for performing the method of decoding an encoded audio signal to obtain an output signal, wherein the encoded audio signal has a first encoder output signal, which is encoded with a high time resolution and a low frequency resolution, and wherein the encoded audio signal further has a second encoder output signal, which represents a residual signal encoded with a high time resolution and a low frequency resolution, which represents a difference between an original audio signal and a decoded audio signal, wherein the decoded audio signal can be obtained by decoding the first encoder output signal, wherein the first encoder output signal has been generated using a first transform encoder wherein the first transform encoder is adapted to convert a block with a high number of time samples of the audio signal into a spectral representation to obtain the first encoder output signal, wherein the second encoder output signal has been generated using a second transform encoder, and wherein the second transform encoder is adapted to convert a block with a low number of time samples of the audio signal into a spectral representation to obtain the second encoder output signal, the method comprising:

extracting the first encoder output signal and the second encoder output signal from the encoded audio signal;

decoding, adapted to the first transform encoder, the first encoder output signal to obtain the decoded audio signal, wherein the step of decoding is adapted to operate with the low time resolution and the high frequency resolution, and wherein the step of decoding is adapted to convert a block with a first number of spectral values into a time representation;

decoding, adapted to the second transform encoder, the second encoder output signal to obtain a decoded residual signal, wherein the step of decoding is adapted to operate with the high time resolution and the low frequency resolution, and wherein the step of decoding is adapted to convert a block with a second number of spectral values into a time representation, the second number being smaller than the first number; and combining the decoded audio signal and the decoded residual signal to obtain the output signal, when the program runs on a computer.

* * * * *